US006796434B2

(12) United States Patent
Kako et al.

(10) Patent No.: US 6,796,434 B2
(45) Date of Patent: Sep. 28, 2004

(54) SHEET HANDLING MACHINE WITH THICKNESS DETECTION OF MULTIPLE PARTS OF SHEET

(75) Inventors: Yutaka Kako, Nishikamo-gun (JP); Riichi Katou, Nagoya (JP)

(73) Assignee: Hitachi, Ltd., Tokyo (JP)

( * ) Notice: Subject to any disclaimer, the term of this patent is extended or adjusted under 35 U.S.C. 154(b) by 204 days.

(21) Appl. No.: 09/969,159

(22) Filed: Oct. 3, 2001

(65) Prior Publication Data

US 2002/0060421 A1 May 23, 2002

(30) Foreign Application Priority Data

Oct. 5, 2000 (JP) ..... 2000-306027

(51) Int. Cl.[7] ..... B07C 5/07; B65H 7/06

(52) U.S. Cl. ..... 209/603; 271/3.15; 271/259; 271/261; 271/262; 209/534

(58) Field of Search ..... 209/603, 534; 271/3.15, 262, 263, 259, 261

(56) References Cited

U.S. PATENT DOCUMENTS

| | | | | | |
|---|---|---|---|---|---|
| 4,729,566 | A | * | 3/1988 | Molitor | 473/600 |
| 4,982,947 | A | * | 1/1991 | Milne | 271/263 |
| 5,250,803 | A | * | 10/1993 | Christ et al. | 250/223 R |
| 5,295,196 | A | * | 3/1994 | Raterman et al. | 382/135 |
| 5,437,445 | A | * | 8/1995 | Chang et al. | 271/263 |
| 6,128,402 | A | * | 10/2000 | Jones et al. | 382/135 |
| 6,241,244 | B1 | * | 6/2001 | Modi | 271/262 |
| 6,588,570 | B2 | * | 7/2003 | Negishi | 194/207 |
| 6,672,587 | B1 | * | 1/2004 | Mohringer et al. | 271/259 |
| 6,720,546 | B1 | * | 4/2004 | Foret et al. | 250/223 R |
| 2003/0141653 | A1 | * | 7/2003 | Kumamoto et al. | 271/262 |

FOREIGN PATENT DOCUMENTS

| | | | | |
|---|---|---|---|---|
| JP | 5-270698 | * | 10/1993 | 271/263 |
| JP | 5-278901 | | 10/1993 | |
| JP | 6-329299 | | 11/1994 | |
| JP | 2003-91757 | * | 3/2003 | 271/263 |

* cited by examiner

*Primary Examiner*—Donald P. Walsh
*Assistant Examiner*—Daniel K Schlak
(74) *Attorney, Agent, or Firm*—McDermott Will & Emery LLP

(57) ABSTRACT

There is disclosed a sheet handling machine capable of surely verifying whether the number of bills is one or not based on the kind of a bill even when bills different in thickness are inserted, handling the bills of different thickness mixed in, dealing with new bills issued in recent years using various novel feature technologies for bill forgery prevention, and detecting the presence of a foreign object in the bill surface. The kind of each of bills successively fed in is specified by bill checking means for identifying the kind of a bill, and reference thickness information regarding the sheet of a specified kind is read from a reference thickness table recording a bill kind and the thickness information of a bill full surface. This reference thickness information is compared with the information of thickness actually measured by a plurality of bill thickness means installed to obtain information for a plurality of places of a sheet, and thereby verification is made as to whether the number of sheets is one or not, and as to the presence of a foreign object.

13 Claims, 13 Drawing Sheets

OUTPUT OF DISPLASEMENT SENSOR

FIG. 13

| KIND OF BILL | REFERENCE DIMENSION INFORMATION | | | | SPECIFIC THICKNESS INFORMATION A | | | | | | SPECIFIC THICKNESS INFORMATION B | | | | | | SPECIFIC THICKNESS INFORMATION C | | | | | |
|---|---|---|---|---|---|---|---|---|---|---|---|---|---|---|---|---|---|---|---|---|---|---|
| | | | THICKNESS | | POSITION | | | | THICKNESS | | POSITION | | | | THICKNESS | | POSITION | | | | THICKNESS | |
| | LONGITU-DINAL | SHORT | REFER-ENCE | TOLER-ANE | LONGITUDINAL | | SHORT | | REFER-ENCE | TOLER-ANECE | LONGITUDINAL | | SHORT | | REFER-ENCE | TOLER-ANECE | LONGITUDINAL | | SHORT | | REFER-ENCE | TOLER-ANECE |
| | | | | | STARTING POINT | END POINT | STARTING POINT | END POINT | | | STARTING POINT | END POINT | STARTING POINT | END POINT | | | STARTING POINT | END POINT | STARTING POINT | END POINT | | |
| 01 | 160 | 76 | 0.09 | 0.01 | 76 | 84 | 0 | 76 | 0.10 | 0.01 | 120 | 140 | 40 | 50 | 0.08 | 0.01 | ⋮ | ⋮ | ⋮ | ⋮ | ⋮ | ⋮ |
| 02 | 155 | 76 | 0.09 | 0.01 | ⋮ | ⋮ | ⋮ | ⋮ | | | ⋮ | ⋮ | ⋮ | ⋮ | ⋮ | ⋮ | ⋮ | ⋮ | ⋮ | ⋮ | ⋮ | ⋮ |
| 03 | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 04 | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |

SHEET HANDLING MACHINE WITH THICKNESS DETECTION OF MULTIPLE PARTS OF SHEET

BACKGROUND OF THE INVENTION

1. Field of the Invention

The present invention relates to a sheet handling machine used for, for example an automated teller machine (ATM), and more particularly, it relates to a sheet handling machine suitable for the handling of various bills different in size and thickness all over the world.

2. Description of the Related Art

An ATM is generally constructed in such a manner that bills to be deposited are directly inserted into the deposit port of the ATM, the inserted bills are automatically checked and counted by the bill handling machine of the ATM, the results thereof are displayed in real time, an approval (validation) of the display is entered by a user, and then deposit work for each handling is finished. Such a bill handling machine was constructed and adjusted specifically for bills of each country, because it was only necessary to handle the bills of Japan, Korea or the like, in which it was installed. Especially, sheet thickness checking means for checking the overlapped conveying of bills or the presence of foreign objects on a sheet surface needed to check only the thickness of one kind, as the thickness of a bill distributed in each country, Japan, Korea or the like, is constant irrespective of the kind of a bill.

As such conventional sheet thickness checking means for checking the thickness of one kind, there is, for example "OVERLAPPED SHEET FEEDING DETECTOR" disclosed in JP-A-5-278901. The overlapped sheet feeding detector disclosed therein comprises: a reference roller as a reference for thickness measurement; a detecting roller brought into contact with the reference roller to be displaced; converting means for converting the displacement of the detecting roller into an electric signal; correcting means for correcting an error intrinsic to the reference roller based on the integrated value of the outputs of the converting means. Thus, detecting accuracy is prevented from being affected by the machining accuracy of the reference roller.

SUMMARY OF THE INVENTION

However, in new bills issued in recent years, various novel feature technologies are used for forgery prevention. Many of those features affect the thickness of a bill, the feature technologies are used in a part of the bill surface, and plural kinds of feature technologies are often used for one bill. For the conventional bill, a thickness was substantially constant over a full surface. In the case of the bills of recent years, however, a part of the bill using the feature technologies like those described above is different in thickness from the other parts, consequently causing a partial difference in thickness on the same bill surface. For example, a relatively frequently used security thread is prepared by stitching a thin and narrow tape made of metal or a resin in the manufacturing process of paper of a bill. A part of the security thread is generally thicker than the other parts of the bill surface.

To detect the tape thinner than the thickness of the bill, stuck to the bill surface, it is necessary to detect a change in thickness much smaller than that when the overlapping of bills is detected. However, since it is often the case that the thickness increase of a part of the security thread is substantially equal to the tape thickness, it is impossible to detect the tape of the bill having the security thread. Alternatively, tape detection was impossible only in the vicinity of the security thread.

The conventional technology of the bill handling machine is based on the assumption that a normal bill has a thickness constant on the full surface. No consideration was given to measures for dealing with a bill using novel feature technologies for forgery prevention like those described above.

For directly handling the bill by the bill handling machine, it is necessary to verify that the number of bills to be handled is one. A most reliable method for verifying that the number of bills is one is to check the thickness of the bill, and determine whether the thickness of the bill is equal to the amount of one sheet or more.

However, in the countries all over the world, a thickness was different from one bill to another depending on the kind of a bill even in one country, bills of a plurality of countries were inserted, and so on, varying the thickness of the bill. Consequently, it was impossible to handle the bills by the conventional bill handling machine. In addition, regulations have been gradually softened in Japan or Korea, resulting in the need to simultaneously handle domestic and overseas bills. Also in this case, it was impossible to handle those different in thickness from the domestic bills by the conventional bill handling machine.

The present invention was made to solve the foregoing problems, and it is an object of the invention to provide a bill handling machine for realizing an ATM, capable of surely verifying whether the number of bills is one or not even when bills varied in thickness depending on the kind of a bill are inserted, and a bill different in thickness is mixed in.

It is another object of the invention to provide a bill handling machine for realizing an ATM, capable of dealing with new bills using various novel feature technologies for forgery prevention, issued in recent years.

It is yet another object of the invention to provide a sheet handling machine capable of detecting a foreign object, e.g., a tape or the like, on a bill surface, even when a bill different in thickness is mixed in.

In order to achieve the foregoing object, in accordance with the invention, there is provided a sheet handling machine, comprising at least: sheet checking means for checking a sheet to specified its kind; sheet thickness checking means for checking the thickness of a sheet; and a control unit for controlling the above components. The sheet checking means measures a sheet fed in by various sensors, the result of the measurement is processed at the control unit, and the issuing country, the kind, and so on, of the sheet are specified. After the kind of the sheet has been specified, the control unit refers to the table of a relation between the kind of a sheet and thickness information held beforehand, and reads the reference thickness information of the sheet from the table. Then, a one-sheet determination unit of the control unit compares the information of a thickness actually measured by the sheet thickness checking means with the reference thickness information read from the table, determines that the number of sheets is one, and no foreign objects are present in a sheet surface if a relation therebetween is within a predetermined range, and that the number of sheet is other than one, and a foreign object is present in the sheet surface if the relation is outside the predetermined range.

According to the invention, a plurality of sheet thickness checking means are provided in a direction orthogonal to a sheet conveying direction, thickness information for a plurality of places of a sheet surface in a direction orthogonal to the conveying direction is fetched, and information regarding a portion partially different in thickness due to the use of a feature technology for forgery prevention is also written beforehand. By comparing the information of a thickness actually measured at the plurality of places of a bill surface with the reference thickness information of the full bill surface, it is possible to deal with a bill using a novel feature technology for forgery prevention.

BRIEF DESCRIPTION OF THE DRAWINGS

FIG. 13 is a view showing an example of a reference thickness table content for the bill of FIG. 12.

DESCRIPTION OF THE PREFERRED EMBODIMENTS

Next, detailed description will be made of the preferred embodiments of a sheet handling machine (or bill handling machine) of the present invention with reference to the accompanying drawings.

Figure 1:
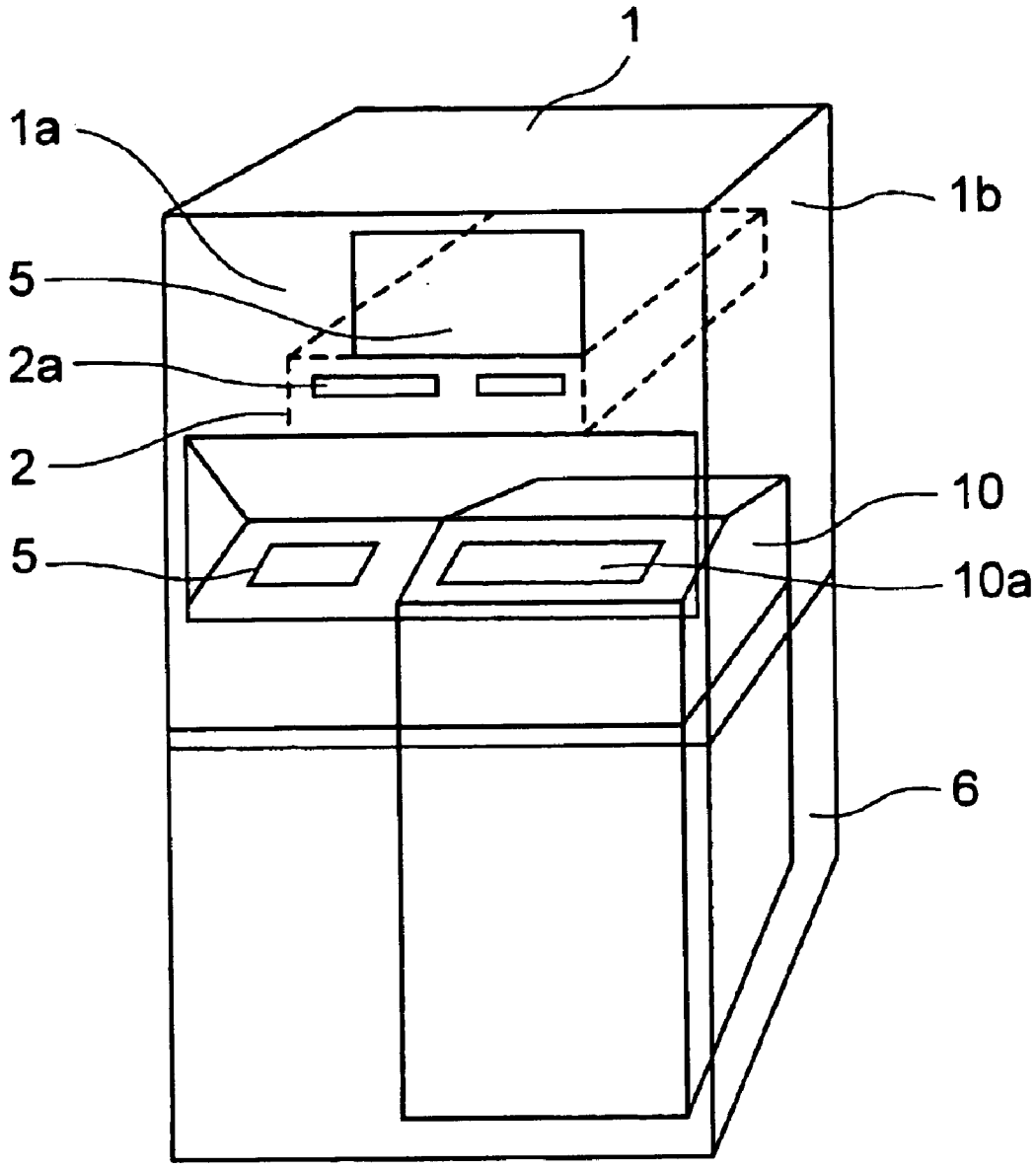
FIG. 1 is a perspective view showing an appearance of an ATM, to which the present invention is applied.

FIG. 1 is a perspective view showing the appearance of an ATM, to which the invention is applied. In its upper side, the ATM denoted at 1 comprises: a card/detail slip processing mechanism 2 communicated with a card slot 2*a* provided in an upper front plate 1*a* to process user's card, and printing and discharging a transaction detail slip; a customer operation unit 5 for displaying and entering the content of transaction. In its lower side, the ATM 1 comprises: a bill handling machine 10 for processing bills, which has a bill slot 10*a* in its upper inclined surface. This ATM 1 can process user's deposit, payment, transfer, and so on, by using a card, a bill or a detail slip as a medium.

Figure 2:
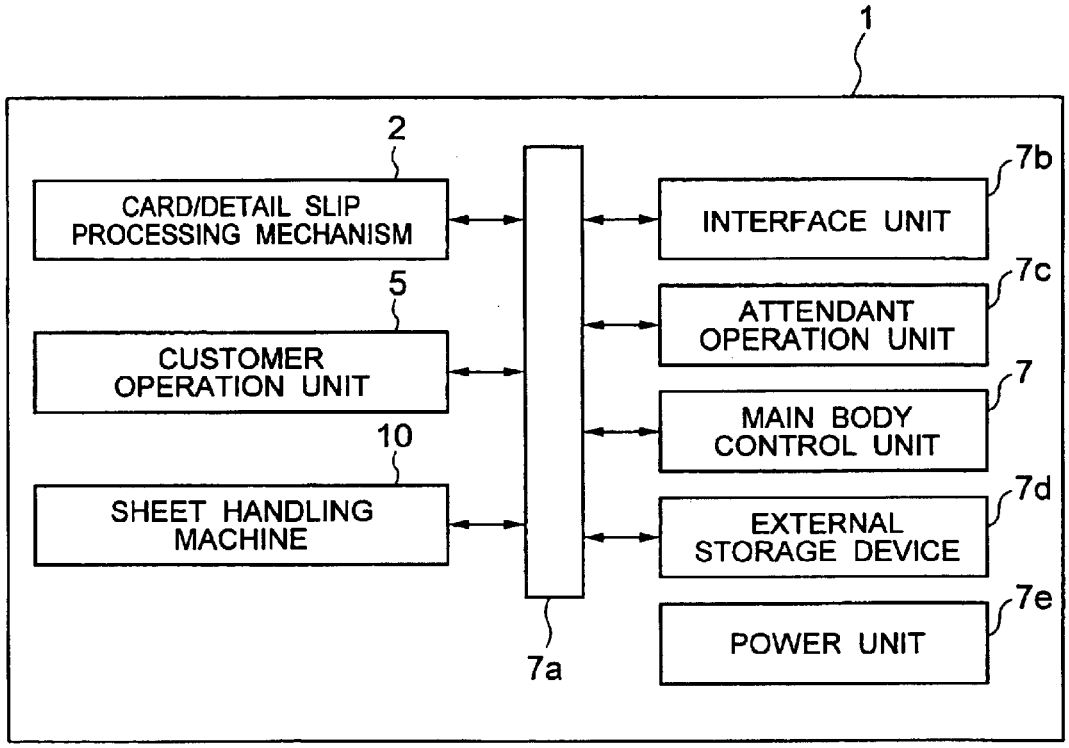
FIG. 2 is a control block diagram showing a control relation of the ATM.

FIG. 2 is a control block diagram showing the control relation of the ATM 1. The card/detail slip processing mechanism 2, the bill handling machine 10 and the customer operation unit 5 housed in the ATM 1 are connected through a bus 7*a* to a main body control unit 7, and perform necessary operations based on control by the main body control unit 7. The main body control unit 7 includes an interface unit 7*b*, an attendant operation unit 7*c*, and an external storage device 7*d*, which are also interconnected through the bus 7*a*, and perform necessary data transfer. However, these portions are not directly related to the features of the invention, and thus detailed description thereof will be omitted. A reference numeral le shown in FIG. 2 denotes a power unit for supplying power to each of the above mechanisms and components.

Figure 3:
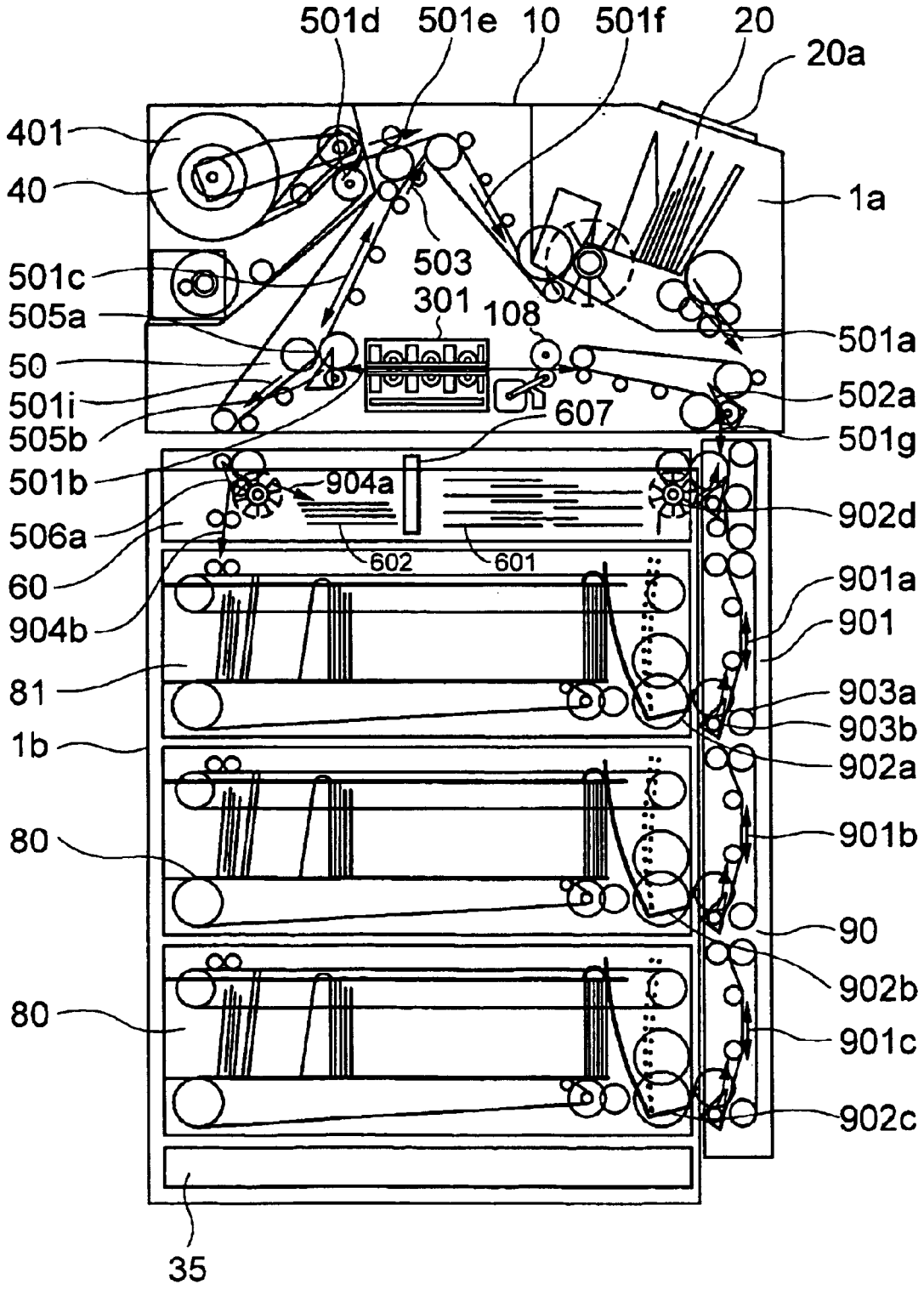
FIG. 3 is a side view showing an example of a configuration of a bill handling machine.

FIG. 3 is a side view showing the configuration of the bill handling machine 10 of the ATM 1 shown in FIG. 1.

The bill handling machine 10 comprises: a reception/payment port 20, through which the user inserts/takes out bills; sheet checking means 301 for determining a bill; sheet thickness checking means 108 for determining that the number of bills is one (not plural); a temporary depository 40 for temporarily storing an inserted bill until the establishment of transaction; a rejection house 60 for housing rejected bills; two recycling houses 80 serving for both reception and payment; a loading/recovering house 81 for housing bills to be supplied to the recycling house 80 or bills recovered therefrom; a bill conveying path 50 for conveying bills; and a control unit 35 for controlling the entire machine.

Structurally, the bill handling machine 10 comprises: an upper bill mechanism 1*a* including the reception/payment port 20, the sheet checking means 301, the sheet thickness checking means 108, the temporary depository 40, and the bill conveying path 50 (501*a* to 501*i* or the like); and a lower bill mechanism 1*b* including the rejection house 60, the recycling houses 80, the loading/recovering house 81, and a conveying path 90 (901*a* to 901*c*, 902*a* to 902*d*, 904*a* to 904*b* or the like) disposed in each house and independently opened/closed for each house during maintenance.

Figure 4:
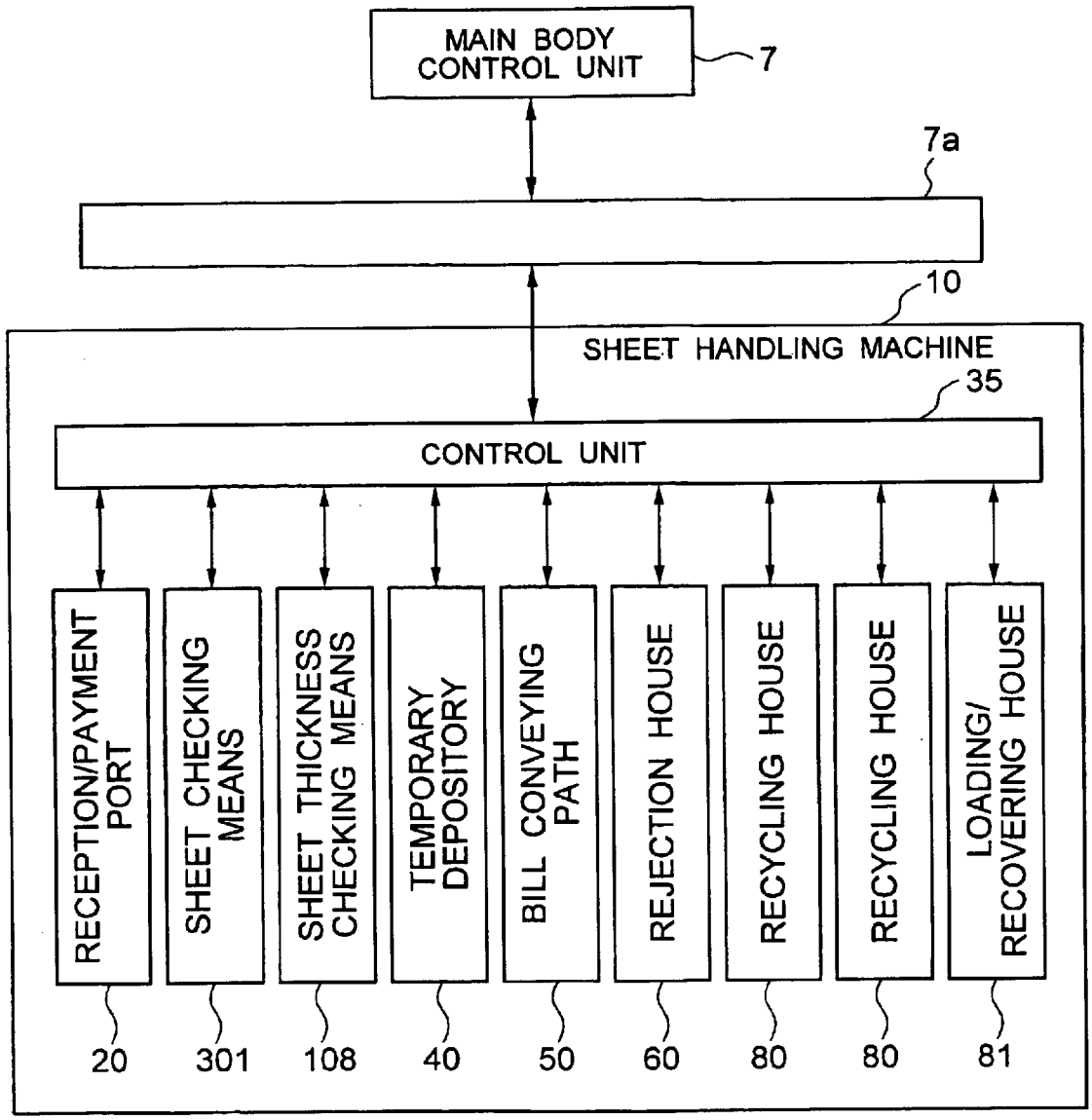
FIG. 4 is a block diagram showing the bill handling machine.

FIG. 4 is a block diagram of the sheet handling machine 10. The control unit 35 is connected through the bus 7*a* to the device main body control unit 7, controls the sheet handling machine 10 according to a command from the main body control unit 7 and the detected state of the sheet handling machine 10, and sends the state of the sheet handling machine 10 to the main body control unit 7 when necessary. In addition, the control unit 35 is connected to the driving motor, the electromagnetic solenoid and the sensor of each unit (reception/payment port 20, the sheet checking means 301 or the like), and drives and controls an actuator while monitoring a sensor state according to transaction.

The bill conveying path 50 is passed through the sheet checking means 301 and the sheet thickness checking means 108 in both directions, and the reception/payment port 20, the temporary depository 40, the rejection house 60, the recycling houses 80 and the loading/recovering house 81 are interconnected through the conveying paths indicated by the arrows 501*a* to 501*i*, 901*a* to 901*c*, 902*a* to 902*d*, and 904*a* to 904*b* shown in FIG. 3. Among the arrows, a one-direction arrow indicates a one-direction conveying path, in which a bill is conveyed only in the arrow direction. A bidirectional arrow indicates a bidirectional conveying path, in which a bill is switched in entire one of both directions and conveyed for each transaction operation.

Figure 5:
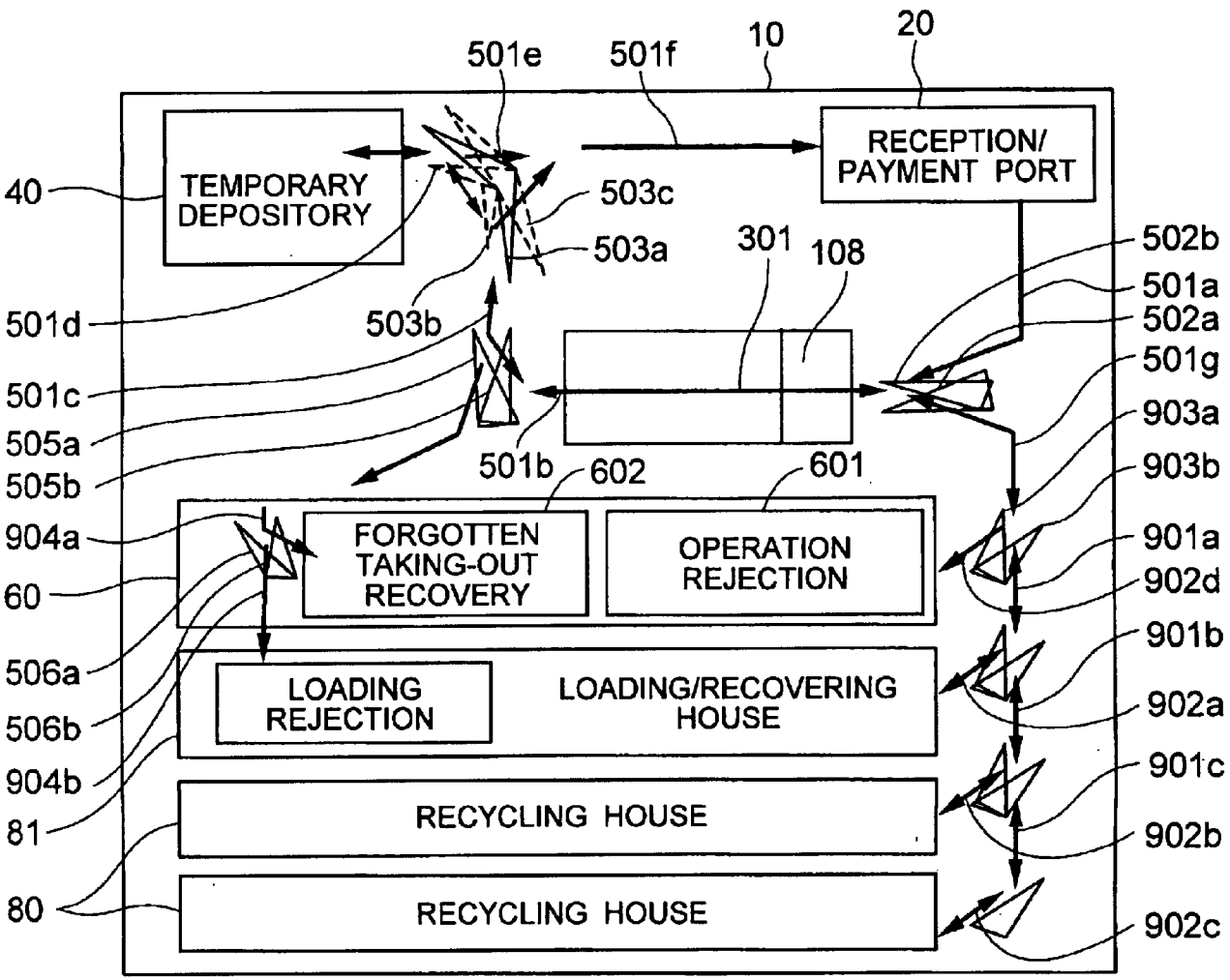
FIG. 5 is a view schematically showing a relation between a bill conveying path and each unit of FIG. 3.

FIG. 5 is a view schematically showing a relation between the bill conveying path 50 and each unit shown in FIG. 3. Such a bill conveying path is driven using a not-shown driving motor by the control unit 35, and the rotational direction of the motor is switched for each transaction operation as schematically shown in each of FIGS. 6 to 9. The bill conveying path 50 has branch points at switching gates 502, 503*m* 504 and 505 and three places of 903 and, for each transaction operation, a bill conveying direction is switched, e.g., a signal a, b or c.

In the bill conveying path 50, three bill conveying paths 901*a* to c, and 902*a* to c in front of the rejection house 60, the recycling houses 80, and the loading/recovering house 81 constitute an opening/closing conveying path 90 to be integrally opened/closed in the lower bill mechanism 1*b*. The attendant can operate each of the rejection house 60, the recycling houses 80, and the loading/recovering house 81 by opening the corresponding opening/closing conveying path 90.

The temporary depository 40 has a function of successively housing bills entered through the reception/payment port 20, the kinds thereof having been verified by the sheet checking means 301, to a rotary drum 401 (see FIG. 3) at the time of deposit transaction, temporarily withholding an operation until the transaction is established, and successively discharging the bills from the rotary drum 401 after the establishment of the transaction. According to the embodiment, as described in detail later, the temporary depository 40 also has a function of housing bills to be rejected, the kinds thereof being not verified by the sheet checking means 301, at the time of payment transaction, temporarily withholding an operation until a payment operation is finished, and discharging the bills to be rejected, at the time of a payment rejection housing operation after the end of the payment operation.

The rejection house 60 includes two housing portions 601 and 602 partitioned front and rear by a partition plate 607. Bills housed in the front housing portion 601 are conveyed through a bill conveying path in the horizontal direction of an arrow 902*d* by changing the switching gate 903 to a state 903*b* shown, and collected.

In the embodiment, as described later, the front housing portion 601 houses bills (non-circulated bills) not housed (not used for payment) in the recycling house 80 during deposit transaction, bills not determined for kind by the identification unit during payment transaction, and abnormally conveyed bills. This portion is called an operation rejection housing portion. On the other hand, the rear housing portion 602 houses bills forgotten to be taken out to continue next user's transaction when the user forgets to take out paid-out bills. This portion is called a forgotten taking-out recovery portion.

The operation rejection housing portion 601 has a space for housing about 500 bills, and the forgotten taking-out recovery portion 602 has a space for housing about 200 bills. The partition plate 607 disposes the front housing portion side to be wider according to the capacity ratio of the two housing portions. However, by variably adjusting the position of the partition plate 607, the housing portions can be put to various uses in accordance with the purposes of the bills to be housed.

Next, description will be made of reception and payment transactions, representative operations of the bill handling machine of the embodiment, by referring to FIGS. 6 to 9, each schematically showing the bill handling machine 10.

Figure 6:
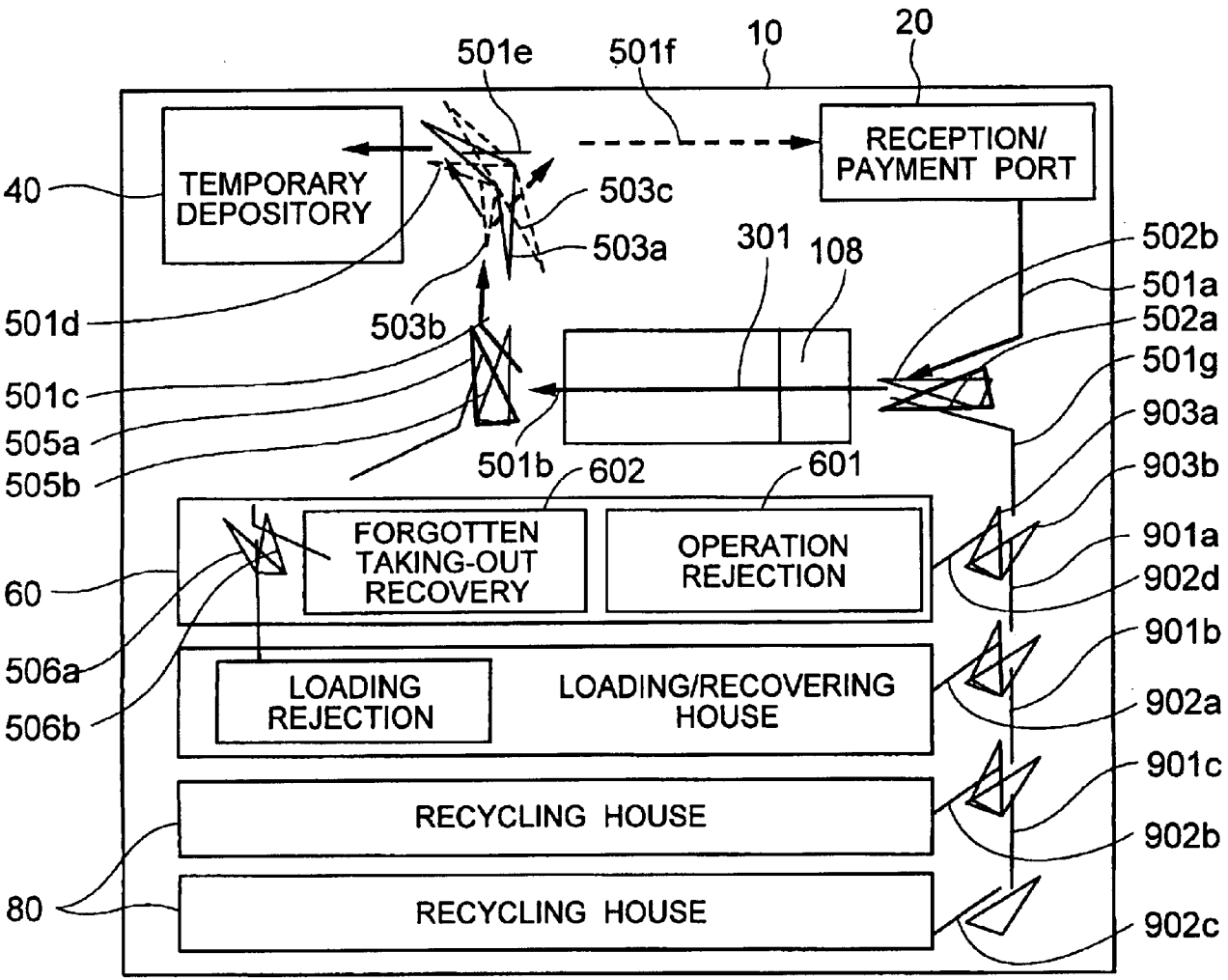
FIG. 6 is a view illustrating an operation at the time of counting money received.
Figure 7:
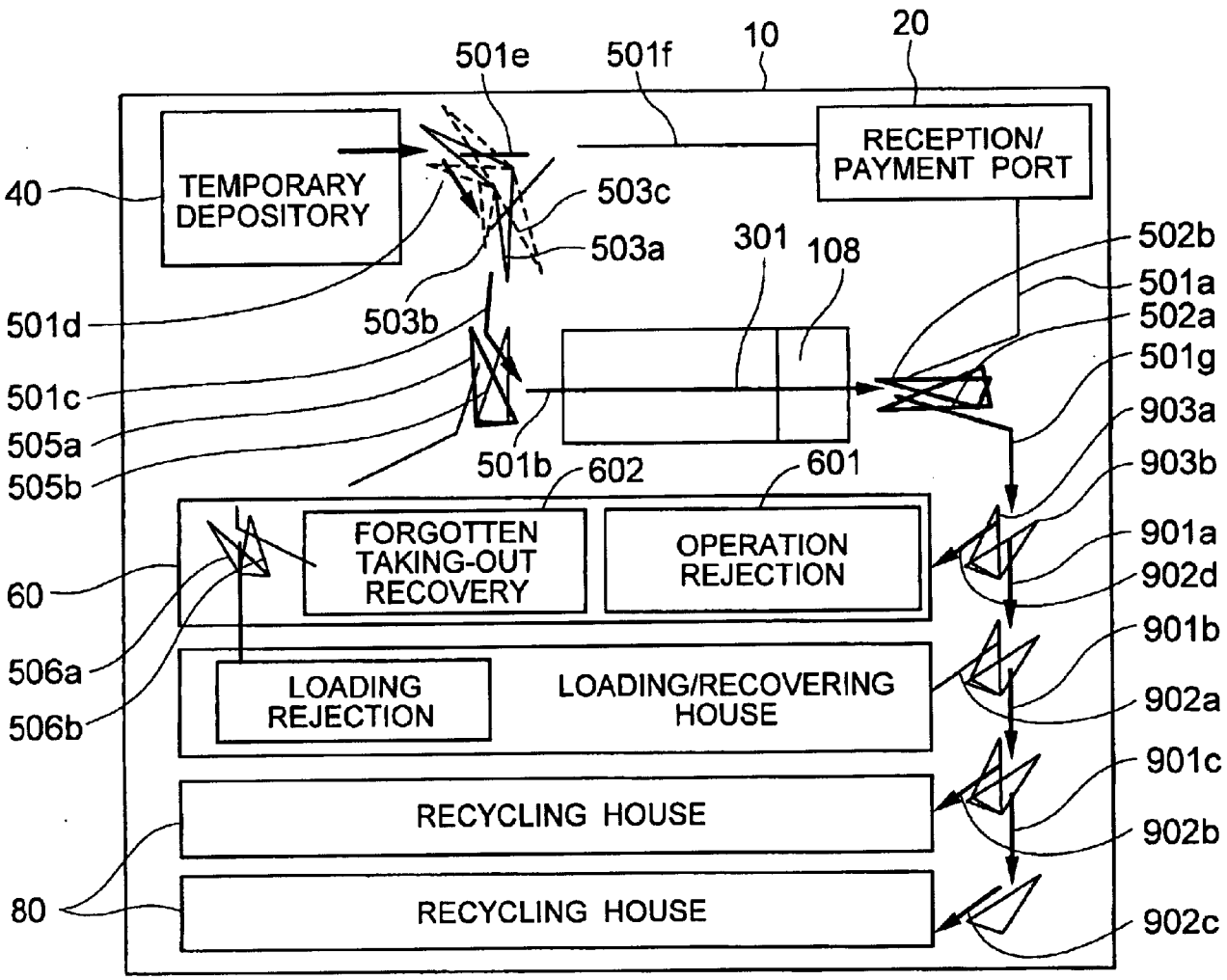
FIG. 7 is a view illustrating an operation at the time of storing money received.

With regard to deposit transaction, there are basically two operations: a deposit counting operation for counting bills inserted by the user shown in FIG. 6; and a deposit housing operation for housing bills in each house for each kind after the user enters the verification of the amount of money counted shown in FIG. 7.

[Deposit Counting]

FIG. 6 illustrates an operation at the time of deposit counting. During deposit counting, bills inserted through the reception/payment port 20 are separated one by one, and conveyed in the arrow directions 501*a* and 501*b*. At this time, the sheet thickness checking means 108 verifies that the number of bills is one, and the sheet checking means 301 makes determination as to the kind of a bill and genuineness. The process of the deposit counting is structurally as follows: though the thickness checking means 108 is disposed in the upstream side of the sheet checking means 301, for processing, the kind of a bill or the like is determined by the sheet checking means 301 and, then, upon the reception of the result, the thickness of a bill is checked by the thickness checking means.

The bill that has been determined for its kind and genuineness, the number being one having been verified, is conveyed from the arrow direction 501*c* in the arrow direction 501*d* by changing the switching gate 503 to 503*a*, and temporarily housed in the temporary depository 40. A bill that has not been determined for its kind and genuineness by the sheet checking means 301, a bill, the number being one not having been verified therefore by the sheet thickness checking means 108, or a deposit rejection bill having different inclination or a different space with another bill, is not captured in the temporary depository 40. Instead, by changing the switching gate 503 to 503*b*, such a bill is passed in the arrow direction 501*f*, housed in the reception/payment port 20, and returned to the user.

[Deposit Housing]

FIG. 7 illustrates an operation at the time of deposit housing. This operation is performed after the bill inserted by the user coincides with the kind of a bill or the amount of money counted the device, and this coincidence is verified by the user. During deposit housing, the rotary drum 401 (see FIG. 3) of the temporary depository 40 is rotated reversibly from that during housing, the bills wound on the rotary drum 401 are sent out in a direction (arrow 501*d*) and an order reverse to those during housing, conveyed in the arrow directions 501*c* and 501*b*, and passed through the sheet checking means 301. Then, the switching gate 502 is changed to the arrow direction 502*b* shown, passed in the arrow directions 501*g*, 901*a*, 901*b*, 901*c*, and so on, the switching gate 903 of either one of the rejection house 60 and the recycling house 80 is switched in the arrow direction 903*b*, and then the bills are housed in a specified storage house.

In this case, the kind of a bill and genuineness may be determined again by the sheet checking means 301, and a storage house may be specified based on the result of the determination. However, means may be provided for storing the result of determining all the bills housed in the temporary depository 40 during deposit counting, and a storage house may be specified based on the stored content. The latter method is advantageous in that processing time necessary for specifying the storage house can be shortened, and the arrow portions, 501*g*, 901*a*, 901*b* and 901*c* of the bill conveying path can be reduced. Moreover, by using the thickness checking means 108 to check the thickness of a bill during the deposit housing operation, it is possible to determine the overlapping or the like of bills, and prevent the conveying of two or more bills.

[Payment]

Figure 8:
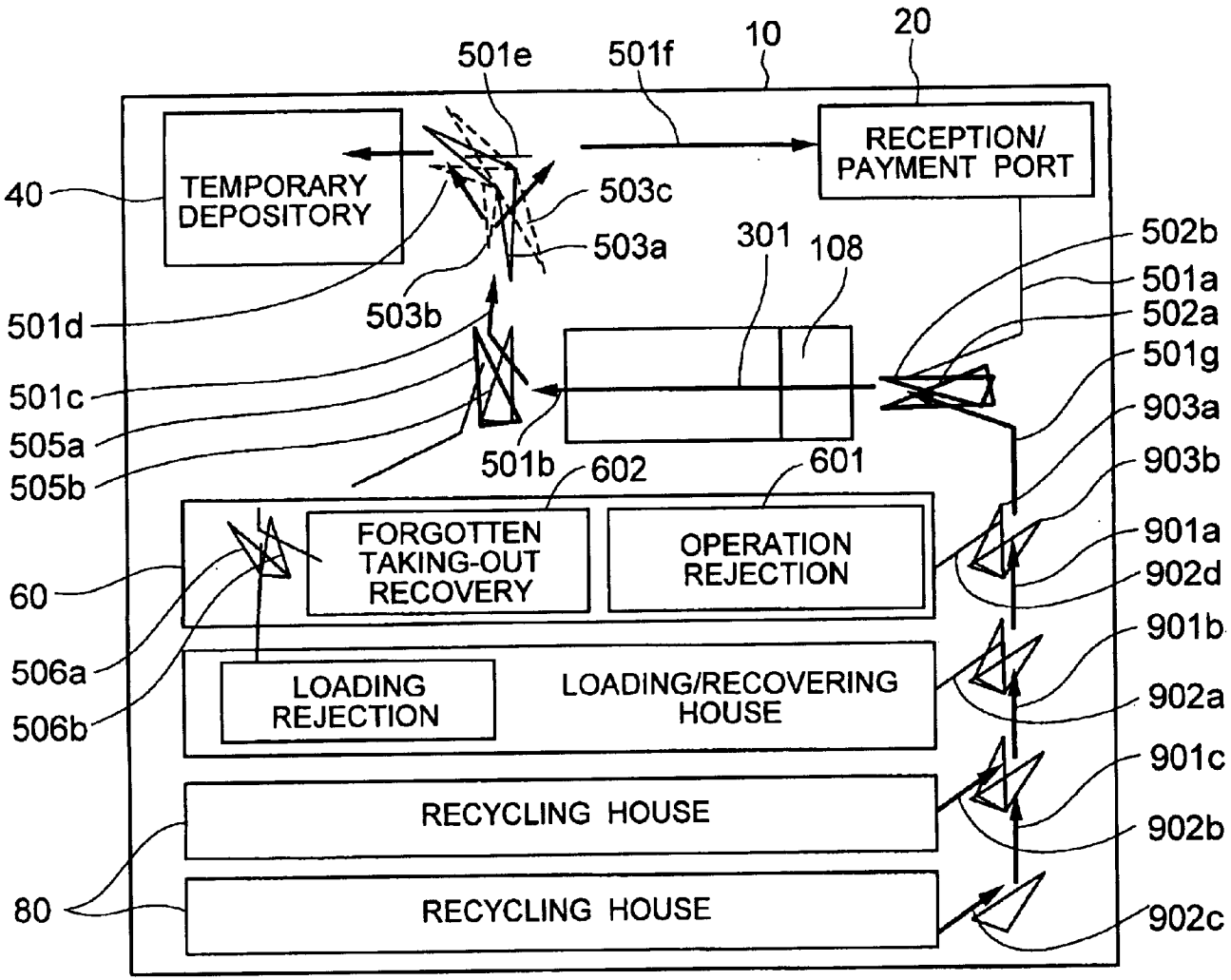
FIG. 8 is a view illustrating an operation at the time of payment transaction.

FIG. 8 illustrates an operation at time of payment. The predetermined number of bills are paid out from the safe of the recycling house 80 for each kind of a bill, and passed in the arrow directions 901*c*, 901*b*, 901*a* and 501*g*. The kind of each bill is determined by the sheet checking means 301, and the number of bills being one is verified by the sheet thickness checking means 108. Then, the bills are branched at the switching gate 503, housed in the reception/payment port 20, and paid out to the user.

When payment rejection occurs, because of the impossible determination by the sheet checking means 301, or the impossible verification of the number of bills being one by the sheet thickness checking means 108, by changing the switching gate 503 to 503*a* shown, the bills are temporarily housed in the temporary depository 40 as in the case of deposit counting. The bills of the shortage are added from the recycling house 80 and delivered.

[Payment Rejection]

Figure 9:
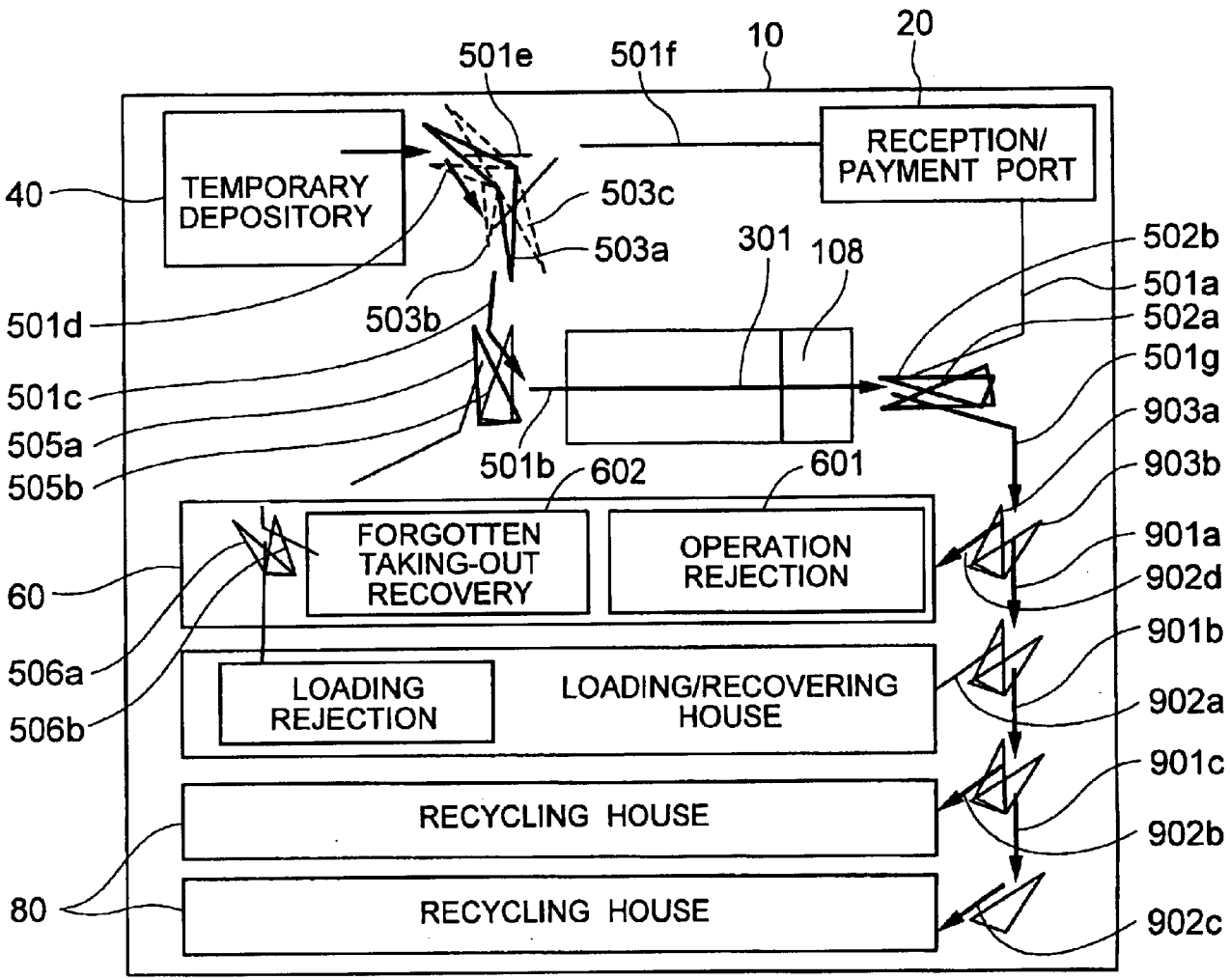
FIG. 9 is a view illustrating an operation at the time of rejecting payment.

FIG. 9 illustrates an operation at the time of payment rejection. When rejection occurs during payment transaction and housed in the temporary depository 40 as shown in FIG. 8, a payment rejection housing operation is performed. Payment rejected bills are all housed from the temporary depository 40 in the rejection house 60 as shown. Alternatively, when the bills are passed through the sheet checking means 301, the kind of a bill and genuineness are determined, and bills to be determined and f a kind to be housed in the recycling house 80 are housed in the recycling house 80. Accordingly, the number of bills to be rejected is reduced, making it possible to increase fund efficiency.

The operation in each transaction was described by way of example, where the kind of a bill is determined, and the thickness of a bill is determined based on the kind of a bill. However, if money kind determination by the sheet checking means 301 is omitted during payment, payment can be performed by a simple method. That is, by using the device to recognize the kind of a bill housed in the recycling house 80 beforehand, it is possible to prevent the feeding of two bills occurring when the bills are delivered from a certain recycling house 80, by reading the thickness data of the kind of the delivered bills from the later-described table, and checking a thickness.

Next, description will be made of the constitution of determining means for determining the thickness of a bill according to an embodiment.

As shown in the drawing, the sheet thickness checking means 109 includes: a reference roller 108-1 attached rotatably around a support shaft; and a detecting roller 108-3 supported by an arm 108-2 supported rotatably around a fulcrum. The detecting roller 108-3 is pressed toward the reference roller 108-1 by a spring 108-4 attached to the arm 108-2. The reference roller 1008-1 and the detecting roller 108-3 are constructed to be rotated in a contact state. In addition, a displacement sensor 108-5 is provided to detect the displacement of the detecting roller 108-3.

Thus, a bill 1000 that has been fed in is conveyed by being held between the reference roller 108-1 and the detecting roller 108-3. In this case, the detecting roller 108-3 is displaced with respect to the reference roller 108-1 by an amount equivalent to the thickness of the bill 1000. The displacement sensor 108-5 detects the displacement of the detecting roller 108-3, and outputs a signal corresponding to the thickness of the bill.

A control unit 201 includes: a one-bill determination unit 201-1; and a reference thickness table 201-1 describing a plurality of bill issuing countries, the kind of a bill, and the thickness information of the bills. For convenience of explanation, the control unit 101, the control unit 35 of the sheet handling machine 10, and the main body control unit 7 of the ATM 1 were illustrated as different units. Needless to say, however, the constitution of integrating these control units can be employed.

The sheet checking means 301 includes conveying roller pairs 301-1, 301-2 and 301-3, and bills are conveyed between sheet guides 302-1 and 302-1 having magnetic, visible light, infrared-ray, fluorescent and other sensors 304 for detecting the characteristic of bills. The output of each sensor 304 for detecting the characteristic of the bill is sent to a checking determination unit 201-3 provided in the control unit 201, processed by an algorithm corresponding to the sensor, and checking and determination are made as to a bill issuing country, the kind of a bill, and so on.

The result of the checking and determination at the checking determination unit 201-3 is directly sent to the control unit 35 of the bill handling machine 10, used for control or necessary business processing in the sheet handling machine 10, and simultaneously sent to the one-bill determination unit 201-1.

At the one-bill determination unit 201-1, access is made to the reference thickness table 201-2 depending on the checking and determination result received from the checking determination unit 201-3, and reference thickness information corresponding to the concerned bill issuing country and the kind of a bill is read.

In addition, the output of the displacement sensor 108-5 of the sheet thickness checking means 108 is sent to the one-bill determination unit 201-1 of the control unit 201, and the information of the actually measured thickness of a bill surface is calculated from the output of the displacement sensor 108-5.

Subsequently, the one-bill determination unit 201-1 compares the reference thickness information from the table and the actually measured thickness information from the displacement sensor with each other, determines that the number of bills is one if a difference therebetween is within a predetermined range, or that the number of bills is other than one if the difference is outside the predetermined range, and then reports the result of the determination to the control unit 35. In this case, since the position of bills in the direction orthogonal to the conveying direction is not fixed, the checking determination unit 201-3 transmits the position information of the direction orthogonal to the bill conveying direction to the one-bill determination unit 201-1. Upon having received the position information, the one-bill determination unit 201-1 makes determination by aligning the position of the direction orthogonal to the conveying direction of the actually measured thickness information and the reference thickness information.

According to one embodiment of bill thickness determination, thickness information may indicate the sectional area S of a bill conveying direction (see later-described FIG. 11). Since a bill thickness is obtained from the sheet thickness checking means 108 based on the output data of the displacement sensor 108-5, this is integrated in a conveying direction (e.g., a thickness obtained for each fixed period is added). Accordingly, a sectional area S as the information of an actually measured bill thickness can be obtained. Then, the obtained sectional area S is compared with the reference thickness information read from the reference thickness table 201-2. If near equality is determined (within a predetermined error range), it can be determined that the number of bills is one. If it is larger than the value read from the reference thickness table 201-2, then it can be determined that the number of bills is other than one.

The number of sheet thickness checking means 108 may be one in principle. Preferably, however, a plurality may be provided side by side to cover a bill width in the direction orthogonal to the bill conveying direction. In this way, bits of thickness information Si (Si=1, 2, 3, . . . n) for a plurality of places of a bill surface can be outputted. In such a case, plural bits of reference thickness information are also described in the reference thickness table 201-2 corresponding to the positions of the plurality of sheet thickness means 108 disposed side by side in the direction orthogonal to the bill conveying direction. Thus, one-bill determination can be made in each position, improving the accuracy of one-bill determination (see later-described FIG. 11).

Thus, the thickness checking means of the invention takes a structurally novel constitution, where the plurality of thickness checking means are disposed side by side in the direction orthogonal to the bill conveying direction. Specifically, pluralities of reference rollers 108-1 and conveying rollers 108-3 opposite to each other are disposed side by side in a deep direction shown in FIG. 10. For an arm, a spring and a displacement sensor, a structure can be made simple if the reference and conveying rollers can be collectively controlled. There are no reasons that pluralities of arms, springs, and so on, are also necessary. Needless to say, pluralities of arms, springs, and so on, can be provided. Pluralities of such components are not necessary for a general bill, because a thickness is constant on its full surface. However, a thickness in a part of a bill is different from those of the other parts, for example, when a later-described security thread is used for a bill, detailed thickness determination can be made by obtaining data from the pluralities of thickness checking means 108.

Next, description will be made of thickness checking for a bill using a security thread.

In the foreign bills of late years, various feature technologies have been used for forgery prevention. For example, in the case of the bill using the security thread, only the portion of the security thread is thicker.

Figure 11:
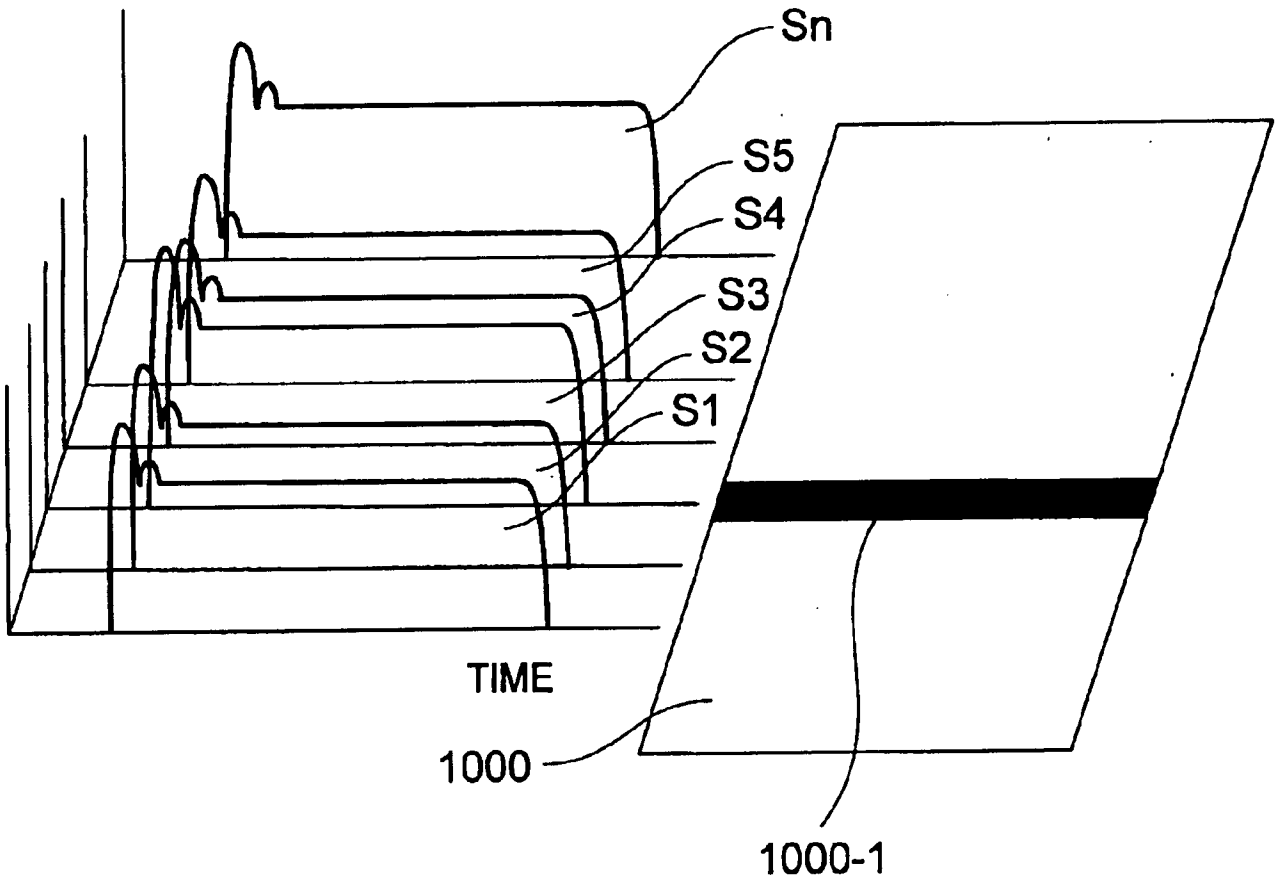
FIG. 11 is a view illustrating checking of a thickness of a bill using a security thread.

FIG. 11 illustrates thickness checking for a bill using a security thread. A security thread 1000-1 is used for a bill 1000, and its portion is thicker than the other parts. As described above, the plurality of sheet thickness checking means 108 are provided and, if thickness checking means provided in the position of the security thread 1000-1 is sheet thickness checking means 1083, then the sheet thickness checking means 1083 supplies an output indicating that a bill thickness is larger than those of the other sheet thickness checking means 108*i* (i=1, 2, 4, 5, . . . n). Accordingly, as shown in FIG. 11, a sectional area S3 as the actually measured thickness information of the security thread 1000-1 is larger than the sectional areas Sn of the other parts.

On the other hand, since the position of the security thread 1000-1 and the thickness of the portion of the same are decided by an issuing country and the kind of a bill, the position of a security thread for each bill and a sectional area as its reference thickness information are written beforehand in the reference thickness table 201-2 corresponding to the issuing country or the kind of a bill, alternatively the issuing country and the kind of a bill.

Figure 10:
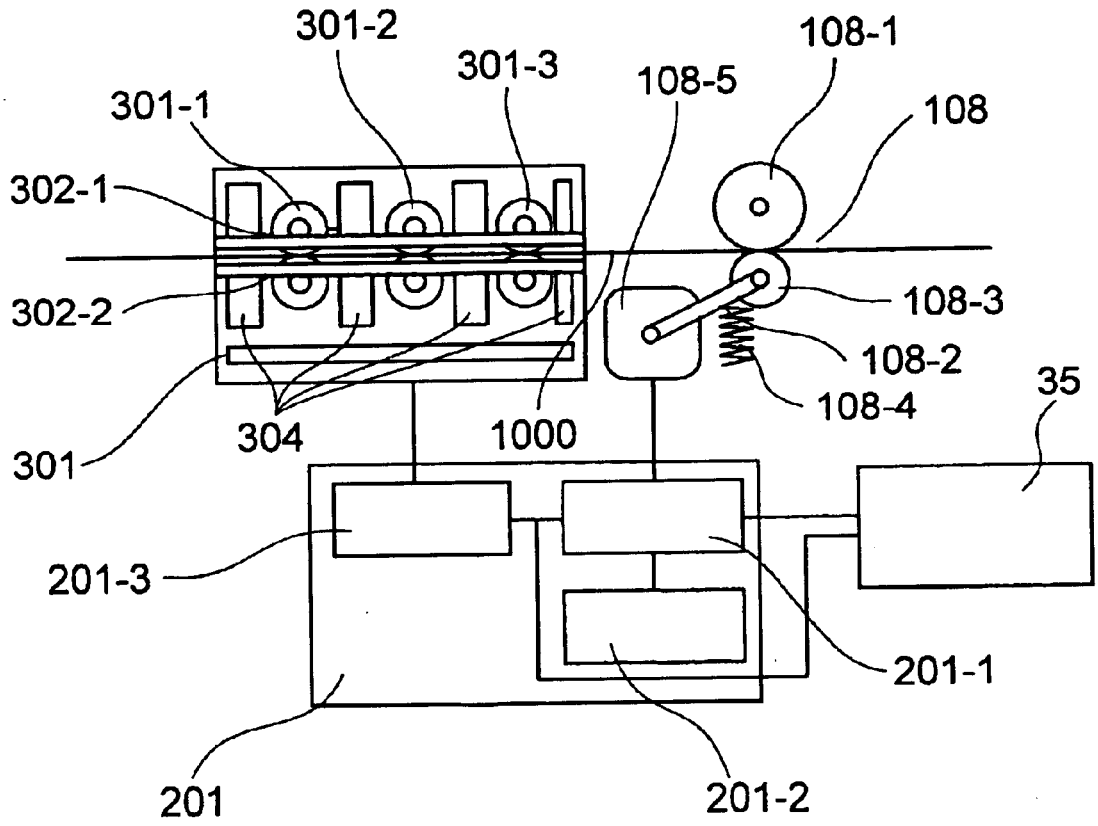
FIG. 10 is a constitutional view of determining means.

The result of checking and determination from the checking determination unit 201-3 shown in FIG. 10 contains bits of information regarding the front and back sides, the left and right sides, the top and bottom sides, the positions of conveying and orthogonal directions when the bill is passed through the sheet checking means 301. Thus, the one-bill determination unit 201-1 reads thickness information corresponding to each position, i.e., sectional areas Si (i=1, 2, 4, 5, . . . ) corresponding to the respective positions of the sheet thickness checking means 108*i* (i=1, 2, 4, 5, . . . ), from the reference thickness table 201-2, and makes comparison, regarding the outputs from the plurality of sheet thickness checking means 108*i* (i=1, 2, 4, 5 . . . ). Especially, for the output from the sheet thickness checking means 1083 having the security thread 1000-1, the sectional area of the corresponding security thread 1000-1 portion stored in the table 201-2 is read, and compared. In this way, even when a thickness is locally different in the bill surface, it is possible to surely check a thickness.

As described above, according to the embodiment, the kind of a bill is first determined by the sheet checking means 301 and, based on the result of the determination, a reference value for the sectional area of the bill is read from the reference thickness table 201-2. On the other hand, based on the thickness output information from the sheet thickness checking means 108, an actually measured value is obtained for a plurality of sectional areas in the bill surface and, by comparing this actually measured value of the sectional areas with the above-described reference value at the one-bill determination unit 2011, determination is made as to whether the number of bills is one or not.

With the foregoing constitution, even when the issuing countries and the kinds of continuously fed-in bills are different, and also the bills are different in thickness, and even when a thickness is varied even in one bill surface, the proper reference thickness information is read for each bill, and bits of actually measured thickness information are sequentially compared. Thus, it is possible to make sure determination as to whether the number of bills is one or not.

Now assuming that the ATM 1 and the bill handling machine 10 process the bills of a plurality of countries, and the thickness of the bill of each of such countries is different from one country to another but constant within the range of each county irrespective of the kind of a bill (e.g., a thickness of Japanese bill is 0.1 mm, a thickness of Korean bill is 0.12 mm, and so on), a bill issuing country and the information of a bill thickness corresponding to the issuing country are stored in the table 201-2. On the other hand, assuming that the ATM 1 and the machine 10 process the bills of one country, and a thickness of a bill is different from kind to kind, the kind of the bill and bill thickness information corresponding to the kind of the bill are stored in the table 201-2. Further assuming that the ATM 1 and the machine 10 process the bills of mixed countries and kinds, bits of bill thickness information corresponding to the issuing countries and the kinds of bills are stored in the table 201-2.

In the foregoing example, the sectional area was described as the reference thickness information in the reference thickness table 201-2. Now, a bill having enhanced security will be described.

Figure 12:
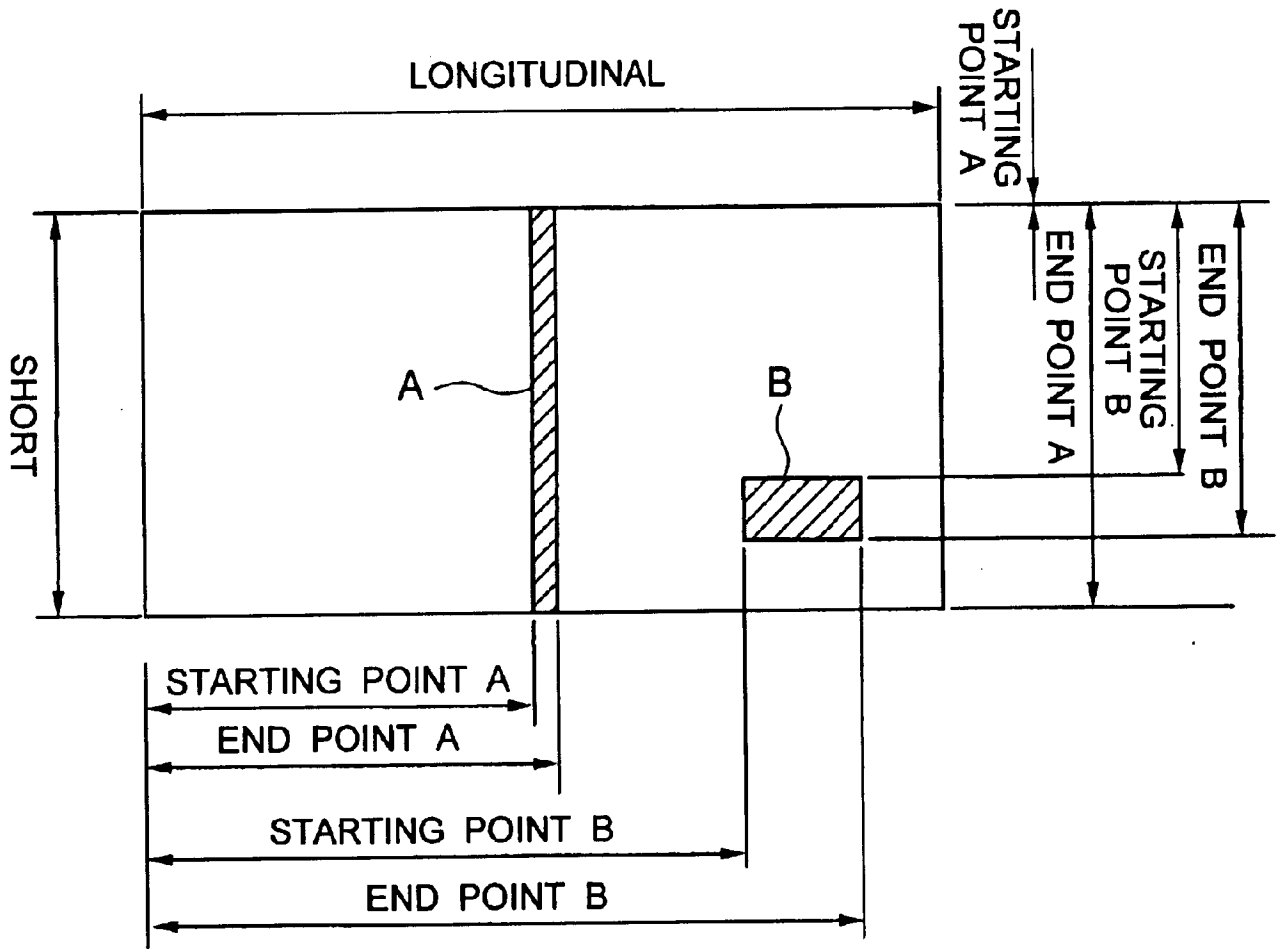
FIG. 12 is a view showing an example a bill having security improved by partially changing a thickness.

FIG. 12 shows a bill having security enhanced by forming a thick A portion and a thin B portion to make forgery difficult; and FIG. 13 an example of a described content in the reference thickness table 201-2.

In the example, in the reference thickness table 201-2, for each kind of a bill (all kinds of bills to be handled irrespective of domestic or overseas bills), in place of the sectional area of a bill in a conveying direction, the reference dimension information (reference size, reference thickness) of the bill, the position and thickness of a specific thickness portion, and tolerance (permissible error) are written.

For example, thickness information described as "KIND OF BILL" in FIG. 13 is for the bill shown in FIG. 12, specifically indicating the following:

(1) as the reference dimension information of the bill, a longitudinal dimension is 160 mm; a short dimension 76 mm; a reference thickness 0.09 mm; and tolerance (permissible error) 0.01 mm, (2) as the specific thickness information of the portion A, a longitudinal starting point is 76 mm; an end point 84 mm; a short dimension starting point 0 mm; an end point 76 mm; the reference thickness of the portion A 0.10 mm; and tolerance (permissible error) 0.01 mm, (3) as the specific thickness information of the portion B, a longitudinal starting point 120 mm; an end point 140 mm; a short starting point 40 mm; an end point 50 mm; the reference thickness of the portion B 0.08 mm; and tolerance (permissible error) 0.01 mm.

By using the reference table 201-2, a thickness of each of all the places of the bill, especially a sectional area as the sheet thickness information of a plurality of optional places in a direction orthogonal to a bill conveying direction, can be obtained. Thus, by comparing the information read from the reference thickness table 201-2 with the outputs from the plurality of sheet thickness checking means 108*i* (i=1, 2, 3, 4, . . . n) (a thickness of an optional position, or a sectional area in the position of the sheet thickness checking means 108*i* installed in the direction orthogonal to the sheet conveying direction may also be used), it is possible to make sure determination as to whether the number of bills is one or not.

The constitution shown in FIG. 10 enables one-bill determination to be made by synchronizing the output from the sheet thickness checking means 108 with the output from the sheet checking means 301 in the control unit 201 even when the bill 1000 is conveyed from right to left or from left to right.

Furthermore, in the foregoing, the example of one-bill determination was taken. Needless to say, however, a similar constitution makes it possible to determine the presence of a foreign object, e.g., a tape, in the bill surface.

As apparent from the foregoing description, the present invention provides the bill handling machine, capable of making sure determination as to whether the number of bills is one or not, and as to the presence of a foreign object, e.g., a tape, in the bill surface with high accuracy, even when a thicken varies from bill to bill, and when a thickness of a part of one bill surface is different.

What is claimed is:

1. A bill handling machine for handling bills, comprising:

a reception/payment port for receiving/paying-out the bills;

a temporary depository for temporarily storing the bills;

a recycling house for housing bills deposited from said reception/payment port and bills to be delivered to said reception/payment port;

a determination unit for determining the kind of a bill;

a thickness detection unit for detecting thickness information of a plurality of places of a bill;

a storage unit for storing thickness information as a reference for a plurality of places of a bill for each kind of a bill; and a control unit for comparing the thickness information of the plurality of places detected by said thickness detection unit with the reference thickness information for the plurality of places stored in said storage unit, and then making determination.

2. A bill handling machine according to claim 1, wherein when a bill is conveyed from said reception/payment port to said temporary depository, said control unit reads the reference thickness information for a plurality of places of the bill from said storage unit based on the kind of the bill determined by said determination unit, compares the read reference thickness information with information of a thickness measured by said thickness detection unit, and then makes determination.

3. A bill handling machine according to claim 1, wherein when a bill is conveyed from said temporary depository to said recycling house, said control unit reads the reference thickness information for a plurality of places of the bill from said storage unit based on the kind of the bill determined by said determination unit, compares the read reference thickness information with information of a thickness measured by said thickness detection unit, and then makes determination.

4. A bill handling machine according to claim 1, wherein when a bill is conveyed from said recycling house to said reception/payment port, said control unit reads the reference thickness information for a plurality of places of the bill from said storage unit based on the kind of the bill determined by said determination unit, compares the read thickness information with information of a thickness measured by said thickness detection unit, and then makes determination.

5. A bill handling machine according to claim 1, wherein when a bill is conveyed from said recycling house to said reception/payment port, said control unit reads the reference thickness information for a plurality of places of the bill from said storage unit based on the kind of a bill housed in said recycling house, compares the read reference thickness information with information of a thickness measured by said thickness detection unit, and then makes determination.

6. A sheet handling machine for handling sheets, comprising:

a port for receiving/discharging sheets;

a housing unit for housing sheets to be recycled;

a conveying path provided to convey bills between said port and said housing unit;

a kind determination unit for determining the kind of a sheet in said conveying path;

a thickness detection unit for measuring thickness of a plurality parts of the sheet in said conveying path;

a storage unit for storing reference information of reference thicknesses corresponding to a plurality parts of each kind of sheet; and a control unit for reading reference information stored in said storage unit corresponding to the kind of the sheet determined by said kind determination unit, comparing the reference thicknesses corresponding to the plural parts of the determined kind of sheet with the measured thicknesses of the plural parts of the sheet, and then making a determination related to a status of the sheet.

7. A sheet handling machine according to claim 6, wherein said control unit determines the number of sheets to be one if a difference between the reference thicknesses of plural parts of the determined kind of sheet and the measured thicknesses of the plural parts of the sheet is within a predetermined range, and to be a number other than one if the difference is outside the predetermined range.

8. A sheet handling machine according to claim 6, wherein said control unit determines a presence of a foreign object on the sheet based on a result of the comparison between the reference information and the measured thicknesses of the plural parts of the sheet.

9. A sheet handling machine according to claim 6 including a plurality of said thickness detection units disposed side by side in a direction orthogonal to a conveying direction of the sheet carried on said conveying path.

10. A sheet handling machine according to claim 6, wherein said thickness detection unit measures a sectional area of the sheet at plural parts of the sheet.

11. A sheet handling machine according to claim 9, wherein each of said plurality of thickness detection units is configured to measure a sectional area of at least one of the plurality parts of the sheet.

12. A sheet handling machine according to claim 6, wherein, for each kind of sheet, the reference information includes a reference thickness for a specific part of the sheet.

13. A sheet handling machine according to claim 12, wherein the reference information further includes the position of the specific portion the sheet, and permissible error information regarding a sheet thickness.

* * * * *